10/8/85 XP 4,545,814

United States Patent [19]

Chou et al.

[11] Patent Number: 4,545,814

[45] Date of Patent: Oct. 8, 1985

[54] PRODUCTION OF COBALT AND NICKEL POWDER

[75] Inventors: Eddie C. J. Chou; Mark W. Cooperrider, both of Arvada, Colo.

[73] Assignee: AMAX Inc., Greenwich, Conn.

[21] Appl. No.: 613,122

[22] Filed: May 23, 1984

[51] Int. Cl.[4] ..... C22B 23/04

[52] U.S. Cl. ..... 75/0.5 AA; 75/0.5 A; 75/108; 75/119

[58] Field of Search ..... 75/108, 109, 0.5 A, 75/0.5 AA, 0.5, 119; 148/408, 409, 105, 22

[56] References Cited

U.S. PATENT DOCUMENTS 2,796,343 6/1957 Shaw ..... 423/109

3,669,643 5/1970 Bagley et al. ..... 75/0.5 AA 4,096,316 6/1978 Tamai et al. ..... 148/105

*Primary Examiner*—John Doll

*Assistant Examiner*—Robert L. Stoll

*Attorney, Agent, or Firm*—Michael A. Ciomek; Eugene J. Kalil

[57] ABSTRACT

Ultrafine cobalt and nickel powders are produced from sulfate solutions containing ammonia under hydrogen pressure in the presence of a small amount of a reductant from the group consisting of metal hydrides, metal borohydrides and metal borides. Cobalt powders having a particle size of about 2 micrometers produced in accordance with the invention have been used successfully in the production of cobalt-cemented tungsten carbide.

5 Claims, 6 Drawing Figures

PRODUCTION OF COBALT AND NICKEL POWDER

The present invention is directed to a hydrometallurgical method for producing fine cobalt and nickel powders, including ultrafine powders having a grain size of 2 micro-meters or even less and having properties which extend the usefulness of cobalt powder in powder metallurgy.

BACKGROUND OF THE INVENTION AND THE PRIOR ART

The production of nickel, cobalt and other metal powders by pressurized hydrogen reduction of aqueous ammoniacal sulfate solutions is a commercial practice pioneered by Sherritt Gorden Mines in Canada. In the process, it has been found that reduction kinetics are improved by the presence of particulate seed material such as fine nickel or cobalt powder. Such powders may come from many sources and may be introduced into the autoclave to act as nuclei for powder formation. U.S. Pat. No. 2,796,343 mentions the production of fine metal particles for use as seed by operations such as grinding of larger particles; precipitation by such reducing agents as hypophosphite, hydrazine and the like which are stronger than hydrogen, decomposition of nickel carbonyl and the limited reduction of acidic solutions. U.S. Pat. Nos. 2,734,821, 2,796,342 and 2,796,343 describe "self-nucleating" solutions in which agents such as stannous, cerous, manganous, ferrous, titanous, vanadous and chromous salts are added.

Known cobalt and nickel powders produced by the hydrogen reduction method are usually coarse, spherical powders since the usual practice is to repeatedly precipitate further metal upon the initially formed particles by further "densifications".

There are needs in the art for ultrafine powders, particularly of cobalt, for purposes such as cementing carbide tools. Such powders may have a grain size of 2 to 3 micro-meters (μm).

Present production methods used for such powders are shrouded in mystery, but are believed to entail solution of cobalt metal in hydrochloric acid, precipitation of the dissolved cobalt as cobalt oxalate or carbonate, filtration, washing, drying, decomposition to cobalt oxide and reduction to cobalt metal by hydrogen at elevated temperature. The resulting powder is then milled and screened and fractions of graded particle size are marketed. The method is complex and capital intensive.

Production of cobalt powder for use in cemented carbides requires much more than control of particle size. Particle morphology apparently is also important. Thus, in the production of hard metals, such as cobalt-cemented tungsten carbide, tungsten carbide powder of graded size between approximately 1 μm and 10 μm in particle size is blended with ultrafine cobalt powder, generally by ball milling with the addition of alcohol. The blended powder is mixed with a lubricant such as paraffin, dried and pressed to shape, dewaxed and presintered and then sintered at high temperature in a controlled protective atmosphere. The purpose of grinding tungsten carbide powder together with cobalt powder is to cover the surface of carbide particles evenly with cobalt. It is particularly important that the cobalt powder should be sufficiently uniform and finely dispersed to obviate the formation of cobalt agglomerates which may cause defects in the structure of the hard metal during sintering. Since the tungsten carbide powder is very fine grained (1 to 10 μm), the cobalt powder must be at least as fine grained as the carbide powder.

The invention is directed to a method for producing ultrafine metal powder, particularly of cobalt but also nickel by a method which is more direct and less capital intensive than presently known methods.

BRIEF SUMMARY OF THE INVENTION

The invention is directed to an improvement in the production of cobalt and nickel powder by hydrogen reduction at an elevated temperature and pressure from an aqueous sulfate solution containing cobalt or nickel ions and ammonia, wherein a compound from the group consisting of metal hydrides, metal borohydrides and metal borides is employed as reductant.

DETAILED DESCRIPTION OF THE INVENTION

Figure 5:
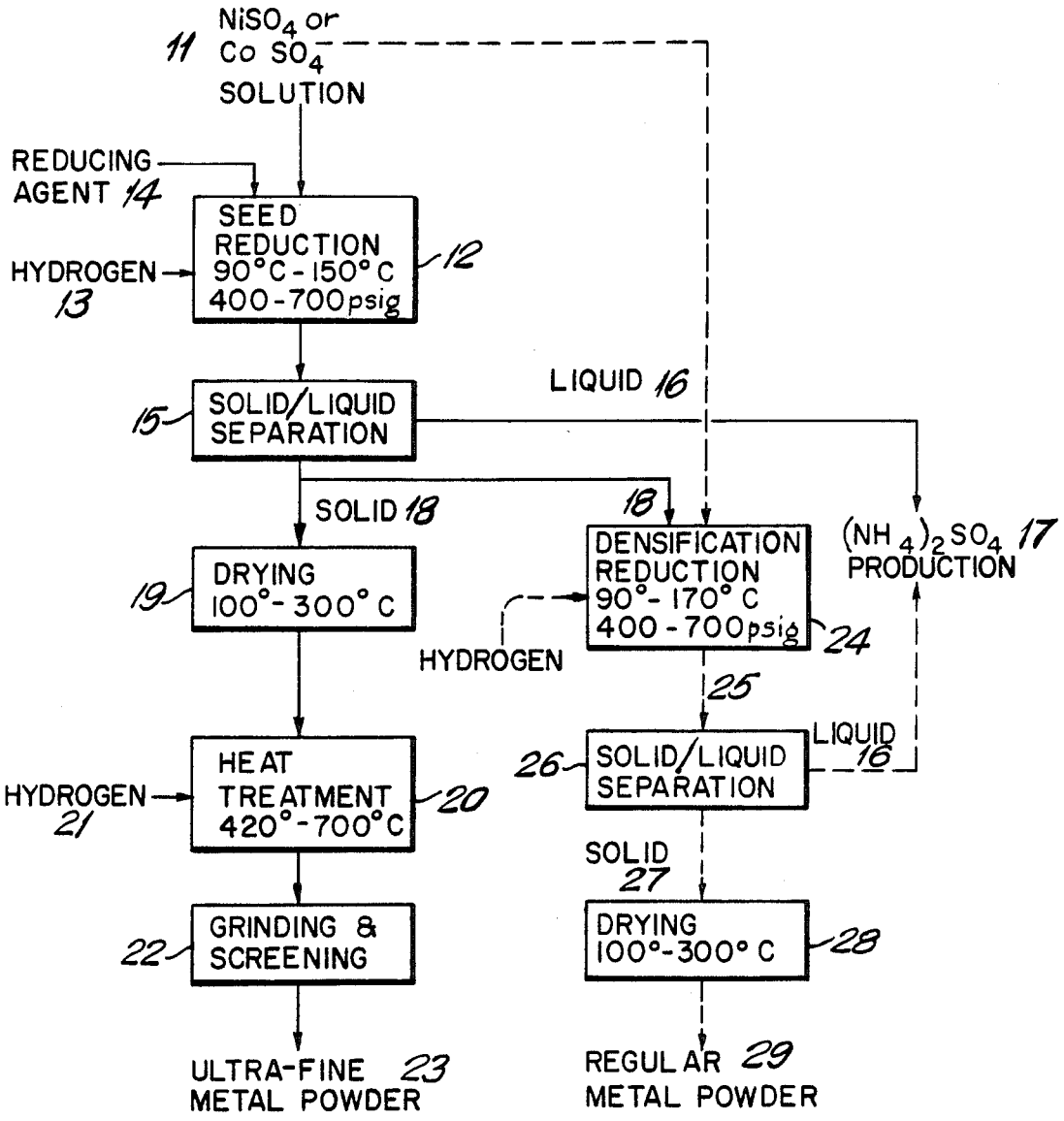
FIG. 5 is a flowsheet of a process as contemplated by the invention.

The invention will first be described in reference to FIG. 5 of the drawing. Reference character 11 depicts the initial or starting solution which in the case of cobalt will generally contain about 30 to about 80 grams per liter of cobalt and in the case of nickel will generally contain about 30 to about 80 grams per liter of nickel. The solution is charged to the autoclave indicated at 12. An ammonia solution can either be added into the autoclave along with the feed solution or during the reduction stage. Ammonia is charged in an amount sufficient to neutralize the acid which is generated by the reactions:

$$CoSO_4 + H_2 \rightarrow Co^\circ + H_2SO_4$$

$$H_2SO_4 + 2\ NH_4OH \rightarrow (NH_4)_2SO_4 + 2H_2O$$

Figure 6:
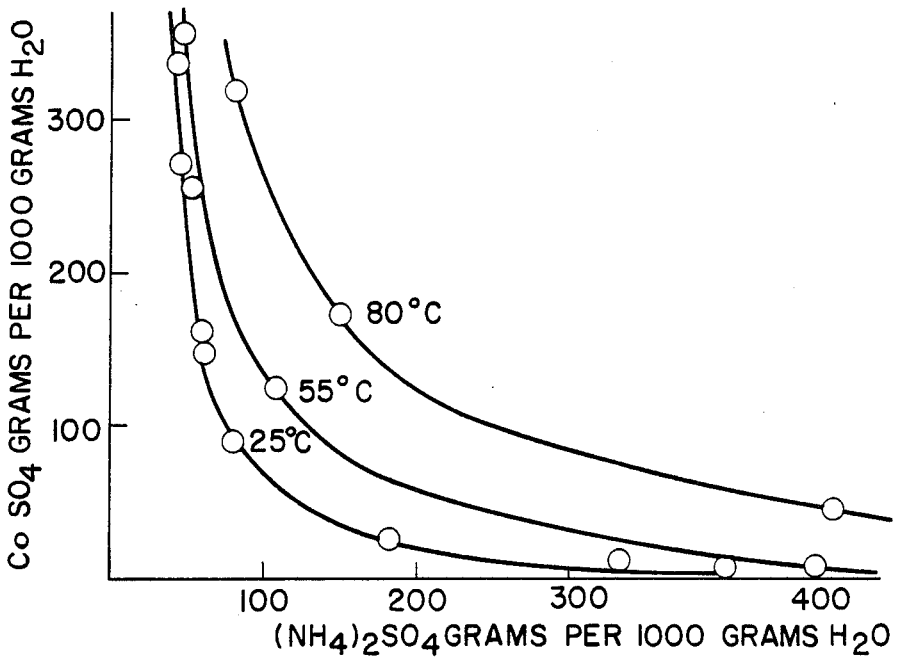
FIG. 6 is a graph showing the solubility of cobalt sulfate as a function of temperature and $(NH_4)_2SO_4$ concentration.

It is to be appreciated that the solubility of cobalt sulfate is a function of temperature and ammonium sulfate concentration and that the precipitation of cobalt-ammonium double salt is to be avoided. FIG. 6 illustrates the solubility of $CoSO_4$ as a function of temperature and ammonium sulfate.

Accordingly, initial conditions within the stirred autoclave will be strongly ammoniacal. The autoclave is pressurized with hydrogen 13 to about 400 to 700 psig, a temperature of about 90° C. to 150° C., the reducing agent 14 from the group consisting of metal hydrides, metal borohydrides and metal borides is introduced and the reduction reactions proceed under favorable kinetic conditions. Only a small amount of the reducing agent is required to initiate and catalyze the hydrogen reduction reaction. As an example, as little as 1.34% by weight of sodium borohydride was found sufficient to obtain a 94% reduction of the cobalt contained in a cobalt sulfate solution (1.35 L, 41.4 g/L Co) which was mixed with 142 ml of concentrated $NH_4OH$, with 0.1 gram TAMOL 731 (a dispersing agent) and 0.75 gram of sodium borohydride (dissolved in 25 ml water) reacted at 95° C., 1000 rpm 540 to 680 psig hydrogen pressure for 65 minutes. The amount of strong reducing agent accordingly can be in the range of about 0.45% to about 1.9%, by weight, of dissolved cobalt or nickel to be reduced. In molar percent, the reducing agent is in the range of about 0.7% to about 3% of the cobalt or nickel to be reduced.

The reduction reaction is continued substantially to completion. The rate of reaction is dependent upon many factors, including hydrogen pressure, temperature, concentration and identity of reducing agent. It is desirable that the reduction be carried out as rapidly as possible and as completely as possible while assuring product quality.

The metal powder product 18 emerging from autoclave 12 is marketable as ultrafine powder after solid-liquid separation 15, with rejection of liquid 16 to ammonium sulfate production 17 and drying 19. If desired for product quality control, the dried powder may be heat treated 20 in hydrogen 21, ground and screened 22 to product 23.

Alternatively the powder product 18 may be used as seed material for densification reduction in autoclave 24 with further batches of cobalt or nickel sulfate solution 11 and with hydrogen being introduced at 90° to 170° C. and a pressure of 400 to 700 psig. Upon completion of densification reduction in 24, the product 25 is taken to solid-liquid separation 26, with rejection of liquid 16 to ammonium sulfate production 17 while the solid product is dried at 28 and prepared for commercial sale at 29. It is to be understood that densification reduction 24 can be repeated a number of times until a powder product of particularly desired particle size is obtained.

As noted previously, the reducing agent contemplated in accordance with the invention will precipitate cobalt or nickel contained in a sulfate solution at atmospheric pressure. As an example, 310 ml of a cobalt sulfate solution containing 27 g/L cobalt and 98 g/L $(NH_4)_2SO_4$ was reacted with agitation at 40° C. for one hour with a freshly prepared sodium borohydride solution (3 grams $NaBH_4$ dissolved in 50 ml water). With solution pH at 3 an amorphous cobalt precipitate with a grain size much less than 1 μm was produced. Only 22% of the cobalt in solution was precipitated and the solids produced assayed 59.4% cobalt 0.068% B and 0.01% S. When the experiment was repeated at pH 7 from ammonia addition, 46% of the cobalt precipitated and the solids contained 66.1% cobalt, 4.45% B and 0.01% S. The solids were amorphous with a grain size less than 1 μm. To 500 ml of another feed solution containing 50 g/L Co at pH 7 was added a solution of 9 grams sodium borohydride in 50 ml water. Only 29% of the cobalt precipitated, the solids contained 38.4% cobalt, 4.2% B and 0.11% S, had a grain size less than 1 μm and were amorphous. All the cobalt precipitates appeared to contain a large quantity of physically and chemically bound water. Heat treatment at 500° C. in hydrogen partially converted the products to the crystalline state and removed much of the bound water. Particular reducing compounds useful in accordance with the invention include sodium borohydride, sodium boride, sodium hydride, potassium hydride, lithium hydride, calcium hydride, barium hydride, barium boride.

Examples will now be given:

In the Examples, a 1.35 liter cobalt sulfate solution initially at pH 2 and containing about 41.4 g/L Co (Examples 1 to 3) or 51 g/L Co (Examples 4 to 6) was mixed with 125 ml (Examples 2 and 3) or 142 ml (Examples 1 and 4 to 6) of concentrated ammonium hydroxide (29% $NH_3$, manufactured by Fisher Scientific Company). In some tests, ammonium sulfate and/or Tamol 731 (an antiplating reagent) were added to and mixed with the feed solution prior to the addition of ammonium hydroxide. The amount of ammonium hydroxide added is sufficient to neutralize the acid generated during the hydrogen reduction of cobalt according to the reaction $CoSO_4+H_2 \rightarrow Co^{\circ}+H_2SO_4$.

The solution is deaerated by bubbling argon for about 10 minutes in an autoclave provided with a propellor-type agitator. Before sealing the autoclave in Examples 1 to 4, a freshly prepared sodium borohydride solution (0.75 g sodium borohydride in 25 ml of deionized water) is added into the autoclave. Argon purging is maintained while heating the solution from room temperature to 40° C. Hydrogen is used to replace argon while heating from 40° to 70° C. When the solution is heating up from 70° C. to a designed test temperature, the partial pressure of hydrogen is maintained at about 40 psig and the agitation at 400 rpm. Once the desired temperature is reached the partial pressure of hydrogen is adjusted to and maintained continuously at the designed pressure. The agitation is increased to 1000 rpm at this state. The time of reduction is not fixed but is dictated by the rate of hydrogen consumption. When the consumption of hydrogen becomes negligible, the agitation is turned off and the autoclave is cooled and depressurized. The slurry is decanted and filtered. The filter cake is washed with 400 ml deionized water. The filtrate and wash water are combined for cobalt analysis. The cake, air dried, is submitted for the analyses of cobalt, boron, and sulfur.

The results obtained are given in the following Table. In Example 5, ⅔ of the metallic residue from Example 4 was used as seed while, in Example 6, ⅔ of the metallic residue from Example 5 was used as seed. In these Examples 5 and 6, strong exothermic reactions were observed.

TABLE

| | Hydrogen Pressure Psig | Temp °C. | Time Min | % Co Precipitated | Solid Assays Co | B | S | Physical Characteristics: Mean Particle Size (Sed) | Grain Size | Density g/ml Free Flow | Packed |
|---|---|---|---|---|---|---|---|---|---|---|---|
| Example 1 | 540<br>680 | 95 | 50<br>35 | 94 | 86.6 | 0.081 | 0.12 | 12 μm | Heterogenous (incomplete | 0.73 | 0.91 |

TABLE-continued

| | Hydrogen Pressure Psig | Temp °C. | Time Min | % Co Precipitated | Solid Assays Co | B | S | Physical Characteristics: Mean Particle Size (Sed) | Grain Size | Density g/ml Free Flow | Packed |
|---|---|---|---|---|---|---|---|---|---|---|---|
| | | | | | | | | | reduction) | | |
| Example 2 | 640 | 135 | 60 | 89 | 99.2 | 0.09 | 0.03 | 130 μm (est.)[1] | 2 μm | Unground: 0.67 Ground: 0.99 | Unground: 0.74 Ground: 1.72 |
| Example 3 | 500 | 155 | 60 | 86 | 97.2 | 0.057 | <0.01 | 600 μm (est.)[1] | 2 μm | Unground: 0.66 Ground: 0.91 | Unground: 0.72 Ground: 1.41 |
| Example 4 | 700 | 100 | 90 | 99.7 | 94.9 | 0.097 | <0.1 | 150 μm (est.)[1] | 2 μm | Unground: 0.57 Ground: 0.89 | Unground: 0.70 Ground: 1.54 |
| Example 5 (First Densification) | 700 | 150 | 90 | 99.7 | 97.7 | 0.043 | | 150 μm (est.)[1] | 3–5 μm[2] | Unground: 1.34 Ground: 1.54 | Underground: 1.43 Ground: 1.73 |
| Example 6 (Second Densification) | 700 | 135 | 90 | 86 | 96 | 0.027 | | 150 μm (est.)[1] | 8–12 μm[2] | Unground: 2.24 Ground: 2.26 | Unground: 2.44 Ground: 2.46 |

[1]Where sedigraph (sed) data were not obtained, particle size given was estimated microscopically.
[2]Particles not reducable to grains by normal grinding.

The powders obtained in the Examples were examined by X-ray diffraction, using Cu K α radiation and in all cases the allotropic forms α and β were found, with α being predominant. Some amorphous cobalt, presumably cobalt hydroxide, was detected in the powder of Example 1. Mean particle size measurements were made using a Micromeritics Sedigraph 5000-D. "Free flow" density is determined by pouring metal powder into a tared weight cup 3 centimeters in diameter by 0.8 centimeters deep and levelling the powder surface along the edge of the cup with a spatula. The packed density is determined by compressing metal powder into the cup by hand with a spatula.

It was found that hydrogen reduction of the powder products of Examples 2 and 3 at 400° and 500° C. in a tube furnace reduced the sulfur and oxygen content of the powders to less than 100 ppm and 2300 ppm respectively. Hydrogen reduction of Example 4 powder at 750° C. resulted in conversion to predominantly beta form cobalt. The beta-form cobalt is face-centered-cubic (FCC) and is stable at higher temperatures, while the alpha form is close-packed-hexagonal (CPH). Comparative analyses of a commercial grade of ultrafine cobalt powder with the powder of Example 2 (with or without heat treatment are presented in the following table:

| Samples | | S % | O % |
|---|---|---|---|
| Example 2 | without heat treatment | <0.02 | 3.7 |
| | heated treated under $H_2$ at 500° C. for 1 hour | 0.01 | 0.23 |
| AFRIMET Co Powder | | 0.01 | 0.74 |

A commercial grade of ultrafine cobalt powder reputed to be satisfactory for the production of cemented carbide tool bodies when examined in the same way as powders of the invention had a mean particle size of about 6 μm, a grain size of about 2–3 μm a free flow density of about 0.98 grams per milliliter and a packed density of about 1.93 grams per milliliter. The powder was predominantly beta-form.

Figure 1:
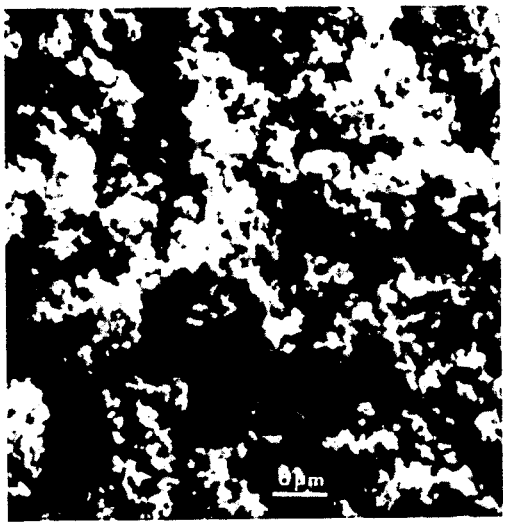
FIG. 1 is a reproduction of a photomicrograph taken by secondary electron microscopy at 1665 diameters of a cobalt powder product produced in accordance with the invention in powder mount.
Figure 2:
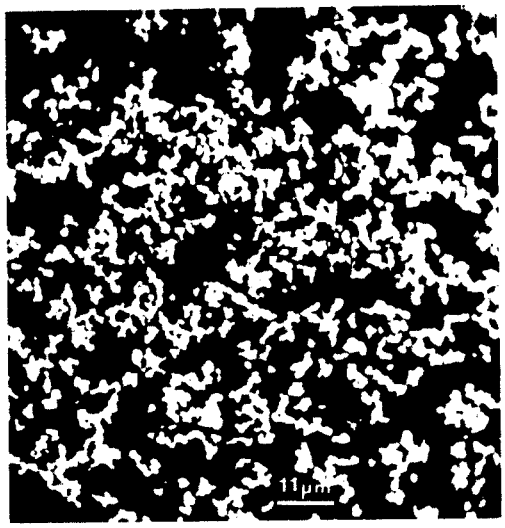
FIG. 2 is a reproduction of a photomicrograph taken at 910 diameters by secondary electron microscopy of the cobalt powder product produced in accordance with the invention in polished section.
Figure 3:
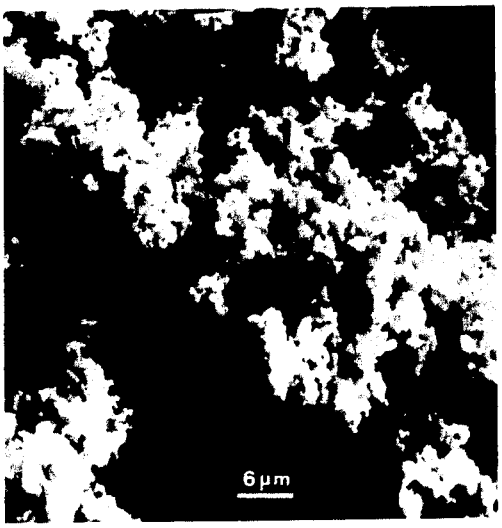
FIG. 3 is a reproduction of a photomicrograph taken at 1665 diameters by secondary electron microscopy of the powder product of the invention after a heat treatment at 500° C.
Figure 4:
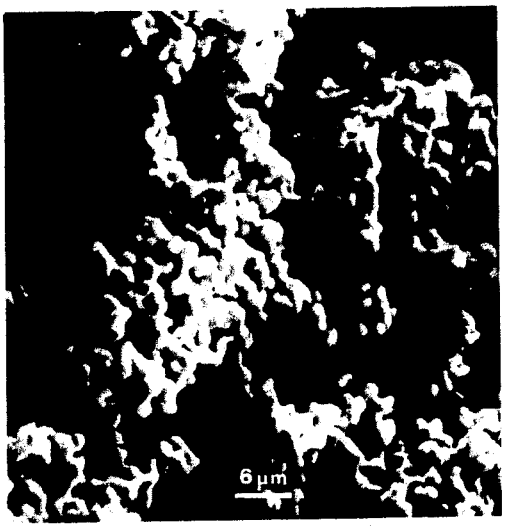
FIG. 4 is a reproduction of a photomicrograph taken at 1665 diameters by secondary electron microscopy of a similar cobalt powder product after a heat treatment at 750° C.

The structure of hydrogen-reduced powder produced in accordance with the invention is illustrated in FIGS. 1 and 2 of the drawing as photomicrographs taken by the secondary electron imaging technique. FIG. 1 depicts the powder of Example 3 taken at a magnification of 1665 diameters while FIG. 2 depicts the powder of Example 3 taken at a magnification of 910 diameters. FIG. 3 depicts the powder of Example 2 at 1665 diameters after a heat treatment in hydrogen at 500° C. FIG. 4 depicts the powder of Example 4 at 1665 diameters after as heat treatment in hydrogen at 750° C. FIGS. 1, 3 and 4 are powder mounts, while FIG. 2 is a polished section. Powder mount photographs indicate grain morphology and size, while polished sections illustrate a plane through the mount and thus indicate the size and tenacity of grain aggregates (i.e. particles) which are not distinguishable in powder mounts. It can be seen from FIG. 3 that hydrogen treatment at 500° C. had essentially no affect on the grain size and morphology of the powder while hydrogen treatment at 750° C. resulted in considerable coarsening of the cobalt grains.

EXAMPLE 7

Powder produced as in Example 2 was mixed with fine tungsten carbide powder having a particle size of about 2.2 micrometers in average in the weight proportion 6% cobalt powder to 94% tungsten carbide powder by ball milling in alcohol for 16 hours. Microscopic examination of the milled powder indicated that the tungsten carbide grains were smoothly coated with cobalt.

Tests indicated that cobalt coating could be achieved in an average of about 12 hours milling whereas about 16 hours milling is required to produce the same result when the commercial ultrafine cobalt powder (Afrimet) which has predominantly beta-form cobalt was used.

Tools were successfully pressed and sintered using the coated tungsten carbide powder produced using the ultrafine cobalt of Example 2, which contains more sulfur and oxygen as compared to Afrimet ultrafine cobalt powder. If it is necessary to reduce sulfur and oxygen contents and to convert alpha to beta cobalt, an additional heat treatment step at about 400° to 700° C. under hydrogen atmosphere is recommended.

What is claimed is:

1. In the process for producing cobalt and nickel powder by hydrogen reduction at an elevated temperature and pressure from an aqueous sulfate solution containing metal ions from the group consisting of nickel and cobalt and ammonia in the presence of a soluble catalyst, the improvement comprising using as said catalyst a compound from the group consisting of metal hydrides, metal borohydrides and metal borides in the amount of about 0.45 to about 1.9 weight percent of said metal from the group consisting of cobalt and nickel in said solution.

2. The process in accordance with claim 1 wherein said catalyst is selected from the group consisting of sodium borohydride, sodium boride, sodium hydride, potassium hydride, lithium hydride, calcium hydride, barium hydride and potassium borohydride.

3. The process in accordance with claim 1 wherein said solution initially contains about 30 to about 80 grams per liter of cobalt sulfate and sufficient ammonia to neutralize the sulfuric acid generated by said hydrogen reduction to product ultrafine cobalt powder having a grain size of about 1 to about 5 micrometers, a free flow density of about 0.5 to about 1 gram per milliliter, a packed density of about 1.4 to about 1.8 grams per milliliter, said cobalt powder being characterized by the presence of cobalt predominantly in the alpha phase and useful in the production of cemented carbide tools.

4. The process of claim 1 wherein an additional hydrogen heat treatment step for about one hour at a temperature of about 400° to about 700° C. is used to reduce sulfur and oxygen content, and to modify grain size, grain morphology, and phase distribution.

5. The process in accordance with claim 1 wherein said solution initially contains about 30 to about 80 grams per liter of nickel sulfate and sufficient ammonia to neutralize the sulfuric acid generated by said hydrogen reduction.

* * * * *